US007336190B2

(12) United States Patent
Giordano, Jr. et al.

(10) Patent No.: US 7,336,190 B2
(45) Date of Patent: Feb. 26, 2008

(54) EARLY DETECTION AND ADVANCED WARNING "WASTE IS BACKING UP" APPARATUS AND METHOD

(76) Inventors: Joseph Giordano, Jr., 300 Richmond Blvd., Ronkonkoma, NY (US) 11779; Daniel Giordano, 45 N. Suffolk Dr., Rocky Point, NY (US) 11778

( * ) Notice: Subject to any disclaimer, the term of this patent is extended or adjusted under 35 U.S.C. 154(b) by 141 days.

(21) Appl. No.: 11/369,039

(22) Filed: Mar. 6, 2006

(65) Prior Publication Data

US 2007/0205906 A1 Sep. 6, 2007

(51) Int. Cl.
*G08B 21/00* (2006.01)

(52) U.S. Cl. ..... 340/608; 340/616; 73/290 R

(58) Field of Classification Search ..... 340/608, 340/616, 506, 593, 612, 618; 73/290 R
See application file for complete search history.

(56) References Cited

U.S. PATENT DOCUMENTS 5,704,389 A * 1/1998 Bouzaglou ..... 137/357
5,859,589 A * 1/1999 McGrew, Jr. ..... 340/614
6,292,103 B1 * 9/2001 Cho et al. ..... 340/604
6,619,118 B1 * 9/2003 Keck ..... 73/304 C
2003/0072577 A1 * 4/2003 Higgins et al. ..... 399/35

* cited by examiner

*Primary Examiner*—Phung T. Nguyen
(74) *Attorney, Agent, or Firm*—Intellectulaw Panagiota Betty Tufariello

(57) ABSTRACT

A device for the early detection and advanced warning that waste is backing up in a waste pipe line comprising: a tubular body member having an open lower portion, a central hollow core extending axially there through, and a closed upper portion. The open lower portion is dimensionally sized and configured to be removably yet sealably fitted and fixed into the waste pipe line. The closed upper portion is provided with a vent. The device further comprises switching means fixedly secured on the upper closed portion and extending from the upper closed portion into the hollow core so that it is surrounded by and housed within the tubular body member; alarm issuing means installed in a remote location distanced away from the installation location of the tubular body but positioned for easy access and viewing; and communications means connecting the switching means to the alarm issuing means so that when the switching means responds to the rise of liquid waste inside the tubular body member as a result of waste backup in the waste pipe line, it closes a circuit and sends a signal along the communication means to the alarm issuing means, to generate an alarm and provide a window of opportunity to clear up the waste back up.

6 Claims, 20 Drawing Sheets

C-C

EARLY DETECTION AND ADVANCED WARNING "WASTE IS BACKING UP" APPARATUS AND METHOD

BACKGROUND OF THE INVENTION

1. Field of Invention

The present invention relates to an apparatus and method for use in residential and commercial waste conduit maintenance systems and procedures. More particularly, the invention relates to an apparatus and method that provides occupants or maintenance engineers of residential and commercial buildings, e.g., homeowner, superintendent, etc., with early detection and advanced warning of waste backing up in a main waste line before the waste spills over into the lowest level of the building.

2. Description of the Prior Art

Buildings which are meant to be occupied or inhabited, are designed and built with indoor plumbing systems. These plumbing systems allow waste which is generated within the buildings to be removed from the buildings and hence allow for the clean, safe and sanitary habitation or occupation of the building.

As the waste is generated at various points within the building, e.g. sinks, toilets, dishwashers, bathtubs, washing machines, etc., it flows through pipe branch lines within the building. These pipe branch lines are connected to secondary pipe branch lines which in turn feed into a main waste line, usually at the lower level of the building. The waste leaves the point it is generated at, travels downwardly through the pipe branch lines and eventually is transported through the main waste line out of the building and into a cesspool, septic tank, or a public sewer system.

There are times, when instead of the waste traveling through the waste line and out of the building, it backs up right into the building's lowest level. This happens primarily as a result of the cesspool or septic tank becoming filled beyond capacity, causing the waste and the fluids associated with the waste to overflow and back up through the main waste line and into the lower level of the building. Or, in the alternative, it happens as a result of the main waste line becoming blocked anywhere close to the point where waste exits from the building.

Once the lower level, such as a basement, becomes flooded due to waste backing up as a result of a blockage in the building's main waste line, or a cesspool overflowing, the building's owner or superintendent will call their waste removal company or plumber to come, pump out and clean the basement. However, even if a plumber gets to the site in a timely fashion, a substantial amount of water and waste will have spilled into the building causing a destructive, costly and unsanitary flood within.

If the lowest levels of the building, such as basements or sub-basements are unfinished and waste backs up into them, then the damage, while serious, can be remedied. However, if the basement is finished and people live or work there, then the damage can be disastrous. Every year, hundreds of thousands, if not millions, of dollars are wasted and countless property is lost due to damage caused by waste backing up, as a result of blockages in buildings' main waste line.

People have tried to solve the problem of waste backing up and spilling into their buildings most commonly by installing an additional overflow cesspool. However in order to install an additional overflow cesspool, not only must one purchase the actual cesspool, one must also pay a contractor to both excavate the property and install the cesspool.

In order to excavate a large enough area, a contractor must use heavy machinery such as a backhoe or a front end loader. These are very large and powerful hydraulic powered machines. They weigh many tons and have large tractor tires. When operating, the tires spin independently of one another. Such spinning destroys lawns and creates mud bogs in wet conditions. This means that after the second cesspool is installed the building owners, as for example the homeowners, have to incur the further cost of tilling their lawn, re-seeding it, fertilizing it and even having to restore the landscaping. Thus, not only do they have to incur the cost of installing a new cesspool, they also have to incur the cost of returning the property to its original esthetic appearance.

The relevant and material prior art has failed to directly address both the problem of waste backing up and overflowing into the lower level of a building, as a result of septic tank overflow, and the unnecessary expense and problem of installing a second cesspool. While there is prior art that deals with the detection of rising sludge in building septic tanks, or with the monitoring of rising content levels in tanks, fuel tanks, vehicle cesspools, i.e., cesspools located on trucks and ships, none of them deal directly with the issue of waste backing up in the main waste line of buildings and the simultaneous alerting of the occupants before the waste overflows and spills into the lower level of the building. Specifically, in the prior art:

a. U.S. Pat. No. 6,217,752 is directed to the field of septic tanks and more particularly to a system of detecting high sludge levels and alerting the owner of the time to consider pumping the septic tank. It discloses a two stage alarm system for detecting the rising level of sludge in the septic tank and similar sedimentary tanks. The system, to detect a first or "caution" level, and a second or "critical" level of sludge, relies upon a pair of vertically positioned, and distanced apart weight sensitive switching mechanisms which, when triggered by the weight of the rising levels of sludge falling on them, will send appropriate signals to a remote alarm mechanism, such as at the residence, to activate a "yellow" and/or "red" light, for example, thus alerting the owner of the tank to the need for remedial action. It is designed to prevent clogging of piping that leads from the septic tank to an effluent disposal field for the septic tank contents. It does not disclose any system or process that alerts the owner of waste backing up in the main waste line of buildings as a result of the septic tank being full, or even more importantly as a result of a blockage in the waste line, before the waste actually overflows into the lowest level of the building. Nor does it disclose a waste management and alarm system installable into the existing plumbing of a construction, whether such construction is old or new or complete, without major reconstruction or implementation costs.

b. U.S. Pat. No. 5,481,911, is directed to water level indicators and more particularly relates to a water level indicator for use in automatically indicating the current water level in a cesspit. The water level indicator includes an expansible element which carries a sliding rod to move up and down relative to a fixed rod responsive to the change of water level in a cesspit. The sliding rod includes an electrical contact in the form of a pin. The pin slidably engages a resistive plate mounted to the fixed rod. The change in electrical resistance is indicative of the change of water level in the cesspit. It was designed to eliminate the necessity of regularly opening and checking the cesspit to determine if it still has empty space for receiving sewage, an action that was both unsavory and unsanitary. It discloses no system or process that alerts the owner of waste backing up in the main waste line of buildings as a result of the septic tank being full or even more importantly as a result of a blockage in the waste line, which can also cause an overflow.

c. U.S. Pat. No. 5,718,146 is also directed to waste level detectors for detecting the level of wastes in a vehicle cesspool. It includes a holder fixedly secured to a vehicle's cesspool by screws, an elongated probe extended downwards from the holder and disposed inside the cesspool, a float movable along the probe, a magnet fixedly secured to the float, a detecting circuit mounted inside the elongated probe to detect the elevation of the magnet, a perforated cylindrical casing having a top end threaded onto the outer thread on the holder and covered around the probe and a bottom end covered with a perforated end cap, and a cover covered on the holder above the cesspool. It was designed to eliminate the drawbacks of vehicle cesspool waste level detectors of that time, including the escape of bad waste smells through the waste level detectors' air vents and the jamming of solid particles which led to the improper functioning thereof. It too, does not disclose any system or process that alerts the owner or occupant of a building of waste backing up in the main waste line of buildings as a result of the septic tank being full, or even more importantly as a result of a blockage in the waste line, which can also cause an overflow.

d. U.S. Pat. No. 6,810,731 for a refined liquid level detector structure is also directed to waste level detectors for detecting the level of wastes in a vehicle cesspool. It includes a liquid level detecting element and a telescopic external casing, wherein the liquid level element includes a circuit device, a holder and a probe, and the probe and the circuit device are respectively set on opposite facets of the holder. Moreover, the telescopic external casing is assembled by plural tubes that are sleeved on each other, and each tube has inclined openings averagely mounted thereon. The length of the external casing can be adjusted to subject to that of the probe and the external casing can be fixedly secured to the holder to be an organic whole. Furthermore, when the liquid level detector is putted in a measuring trough for detecting, the length of the external casing can be adjusted to match with that of the trough. In addition, through the structure described above, foreign particles can be effectively stopped outside the external casing so that the liquid level detecting element can have a best performance. It was designed to allow the user to adjust the external casing to accommodate to a length of a probe, to protect the probe from foreign particles, and to provide, among other things, for a structure that could be matched with all kinds of probe-type liquid level detectors. It was not designed to alert the owner of waste backing up in the main waste line of buildings as a result of the septic tank being full, or even more importantly as a result of a blockage in the waste line, which can also cause an overflow.

e. U.S. Pat. No. 1,646,317 is directed to a simple liquid gauge adapted for use in connection with gasoline tanks. The object of this invention is to gauge the amount of gasoline within a storage tank. It employs a perforated elongated tubular member and a hollow float which rises and falls as the liquid in the tank increases or decreases.

f. U.S. Pat. No. 1,617,287 discloses an electric indicating instrument to be connected in circuit with a source of electricity. It includes an indicator adapted to be variably positioned under the influence of a magnetic force to indicate the quantity of liquid in a tank, by introducing or cutting out predetermined amounts of resistance from the circuit. The instrument is meant to be connected with or inserted in a liquid carrying tank and controlled by the quantity of liquid in the tank which influences the indicating instrument to indicate the quantity of liquid in the tank.

g. U.S. Pat. No. 2,510,633 discloses a liquid gauge which has a plurality of floats each with a sight rod of different length which is effective to indicate the level of the liquid throughout a portion of the depth of the tank. This gauge shows which rod is effectively indicating the level in the tank and can be mounted on the tank with an airtight connection.

h. U.S. Pat. No. 2,868,016 is a liquid level gauge which is placed on the exterior of a tank and indicates the level of liquid in the tank by rise and fall of a float.

i. U.S. Pat. No. 3,992,941 discloses a liquid level measuring apparatus, whereby the level of liquid in a tank or a boiler is determined initially by enclosing the liquid in a column and then sensing the liquid surface in the column by causing a plunger to pass through the non-liquid medium in the column above the liquid to the liquid surface and noting the abrupt change in descent rate of the plunger when it hits the liquid surface due to the great difference between the viscosities of the non-liquid and liquid mediums. The level of liquid in the boiler is reflected on a continuing basis by permitting the plunger to float or levitate in or on the liquid as it is supported by an entrapped gas bubble. The difference in the position of the plunger when it encounters the liquid surface and the position of the plunger thereafter, as it is supported on the liquid is the correction factor that is maintained steadily until pressure or temperature changes necessitate a new determination of that difference with a fresh gas bubble at the current temperature and pressure. In a steam boiler, the plunger is hollow, vented at the bottom and rides in a vertical open cylinder. When the plunger is empty of water, it can "levitate" in the cylinder with the bottom of the plunger at the water level and so, the plunger level indicates water level in the boiler. A magnetic coupled plunger lifting mechanism completely external of the boiler couples magnetically to the plunger for doing the following: lifting the plunger; following the plunger position; and controlling the degree of levitation. By the magnetic coupling, magnetic forces pass between the plunger to an exterior rod and the rod initiates a display of plunger position.

j. U.S. Pat. No. 5,155,311 is directed to a float switch assembly for a submersible pump. The assembly comprises a float rod with two spaced stops, a movable float carried by the rod which moves between the stops in response to fluid level, the rod being mounted in a vertical oriented position for movement upwardly and downwardly in response to float movement against the two spaced stops, a magnetic body carried at the upper end of the rod for movement therewith, a generally U-shaped magnetic follower element with two spaced, magnetically responsive arms on one side of the magnetic body, or two sets of arms disposed on either side of the magnetic body to provide a dual U-shaped arrangement, the follower element being rotatably mounted with the arms thereof in a generally horizontal position, one above the other for movement of the arms thereof upwardly and downwardly in a vertical plane, the arms and magnetic body being positioned relative to each other so as to dispose the magnetic body for movement from arm to arm to thereby allow proximity actuation of the follower by magnetic attraction between an arm and the magnetic body, electrical contact means carried by the follower element, and fixed electrical contact means adapted to make and break with the follower electrical contact means as the follower arms move downwardly and upwardly, respectively, in response to proximity actuation by the magnetic body as controlled by float movement against the stops on the rod.

k. U.S. Pat. No. 5,156,042 is an apparatus for detecting leaks in fuel storage tanks. A float suspended in the tank liquid determines liquid levels and transmits the liquid level information via an infrared beam to a probe processor in the upper portion of the tank. The probe processor stores a plurality of level indications for subsequent uploading to an external computer which analyzes the level information to generate leakage rate information.

l. U.S. Pat. No. 3,969,942 is directed to a liquid level responsive apparatus which includes a tube having a lower terminal end immersed in the liquid in a container uncovered when the liquid level is below the terminal end for discharge of air from the tube, the tube having a small electric motor driven air pump supplying air thereto, the tube having a pressure tap connected to one side of a diaphragm for normally maintaining the diaphragm in one control position, the diaphragm being collapsible to another control position, the tube having a vent of predetermined size for limited venting of air from the tube while the diaphragm is maintained in its one control position. The diaphragm can control a micro-switch which in turn can control any desired operation such as shut-off of delivery. A plurality of tubes can be connected in parallel with their terminal ends in different liquid containers.

m. U.S. Pat. No. 6,672,244 consists of a fuel level indicator system, which includes a housing member that is culpable to a fuel tank. The housing member is positionably adjacent to a vent opening in the fuel tank. The housing member defines an interior space. The housing member has a lower aperture facilitating environmental communication between the interior space and an interior of the fuel tank. The housing member has an upper aperture. A vent portion is coupled to the housing. The vent portion is in environmental communication with the interior space of the housing member via the upper aperture. The vent portion facilitates air flow from the interior of the fuel tank through the housing and out of the system. A whistle assembly is positioned substantially within the housing. The whistle assembly produces an aural indication of airflow through the housing member.

n. U.S. Pat. No. 5,156,047 is directed to a water level sensing probe having a probe body, a protective sleeve, and an external housing. The body contains a detector board that partially protrudes from its bottom and a logic board that partially protrudes from its top. The detector board senses the level of electrically conductive fluid and transmits an indication of that level to the logic board that controls the operation and partially processes the data in response to commands received through a cable. The detector board is protected by the protective sleeve while the logic board is enclosed in the external housing. The probe is used by positioning on the bottom of a fluid containing tank or other vessel. Water at the bottom of the tank forms a bridging contact between a ground plane and a number of traces on the detector board proportional to the level of the water. The detector board then sends an electrical signal to the logic board which partially processes the signal and sends outside the probe for additional processing o. U.S. Pat. No. 5,347,849 is directed to a sensor that detects tank or vessel leakage. It consists of a water level probe comprised of a probe body, a sleeve having openings permitting fluid flow and encasing part of a magnetostrictive sensor, and an external housing encasing electronic circuitry for processing and transmitting the electric signal generated by the magnetostrictive sensor and sealing the circuitry from fluids. The sensor comprises a float slidably mounted on a rod, the float designed to float in water but sink in a petroleum product, thereby ensuring that it will float at the interface between the water and the product. The water level probe is used in the method of the invention to measure the depth of the water in a vessel storing hydrocarbon product at predetermined time intervals. The longitudinal angle of inclination of the vessel with respect of the horizon having previously been determined, the volume of water in the vessel is calculated from the depth measurements. The rate of hydrocarbon leakage is then determined from the calculated volumes to ascertain the rate of change of water volume over time.

It is clear from the above that none of the prior art discloses any system or process that alerts the occupants, or building maintenance engineers, or home owners that waste is backing up in the main waste line of their building as a result of the septic tank or cesspool being full, or even more importantly as a result of a blockage in the waste line; before the waste actually overflows into the lowest level of the building. Nor does such prior art disclose a waste management and alarm system installable without major reconstruction or implementation costs, into the existing plumbing of a construction, whether such construction is old, new, complete, or incomplete.

Furthermore, none of these prior art devices are useful, within the context of overflowing cesspools or main waste lines as all of them must be easily viewed or studied. This means that the cesspool tank or vessel to which they are attached must be above ground. That is totally against code. Or if they are assembled on tanks that are underground they need to be provided with means for easily viewing them.

In addition, because many of the prior art gauges are designed to work on boilers or fuel tanks, they can only work if they sense a differential in viscosities or in densities. Cesspools do not have a differential of either viscosity or density thereby rendering these gauges inapplicable. Finally, none of these gauges can be used in line in a waste line, main or otherwise, because the nature of their structure itself will create a blockage or an obstruction in a the waste line. Such obstruction will hinder the flow of waste, thereby initiating a blockage and causing a flood; the very flood that they are supposed to prevent.

Accordingly, there is clearly a need for a method and apparatus that can address the problem of waste backing up and overflowing into the lower level of a building as a result of (i) septic tank overflow; (ii) cesspool overflow; (iii) waste line blockage; or (iv) sewer blockage and backup, before the waste actually backs up and spills all over to cause damage and destruction. Without such apparatus and method, buildings will continue to be exposed to the damage caused by overflowing, backed-up waste and occupants and insurers will continue to deal with the costs of rectifying such damage. Such apparatus and method need to be easily installable into existing plumbing systems of various constructions, without great costs or tremendous expertise, irrespective of whether the construction is old, new, complete or incomplete, thereby providing the occupants and owners of the buildings with a clear advantage in connection with the maintenance of both their waste management conduits and by extension, their buildings.

OBJECTS OF THE INVENTION

IT IS THEREFORE AN OBJECT of the present invention to provide for early detection and advanced warning that waste is backing up in the main waste line of a building, before the waste overflows and spills all over the lower levels of the building.

IT IS ANOTHER OBJECT of the present invention to prevent costly damage to a building, as a result of waste backing up in the main waste line, overflowing, and spilling out into the lower levels of the building IT IS YET ANOTHER OBJECT of the present invention to provide a window of opportunity for the elimination or removal of the waste blockage in the main waste line, or the pumping of the septic tank, before the waste backs up, overflows and spills out and all over the lower levels of the building.

IT IS STILL ANOTHER OBJECT of the present invention to provide an apparatus and method for the early detection and advance warning that waste is backing up in the main waste line of a building, that are easily installable into existing plumbing systems of various constructions, without great costs or tremendous expertise, irrespective of whether the construction is old, new, complete or incomplete.

IT IS A FURTHER OBJECT of the present invention to provide the occupants, maintenance engineers, and owners of the buildings with a clear advantage in connection with the maintenance of both their waste management conduits and by extension, their buildings.

IT IS ANOTHER OBJECT of the present invention to prevent buildings from being exposed to the damage caused by overflowing, backed-up waste.

IT IS YET ANOTHER OBJECT of the present invention to manage waste backing up in a main waste line in a manner that will minimize both building maintenance costs and insurance fees.

These objects, as well as other objects and advantages will become more apparent in the description that is set forth herein below, particularly when read in conjunction with the accompanying drawings.

SUMMARY OF THE INVENTION

The illustrative embodiments of the present inventive device provide for the early detection and advanced warning that waste is backing up in a building waste pipe transporting the waste out of the building, before the waste actually overflows and spills all over, and more particularly all over the lower levels of the building. The inventive device comprises a tubular body member having an open lower portion, a central hollow core extending axially there through, a closed upper portion, a vent located on said closed upper portion, and switching means extending from said upper portion inwardly so that it is surrounded by said central hollow core, and being provided with means for issuing a warning or an alarm. The lower portion is configured and dimensioned to be removably, but sealably, fixed onto a waste line, either in line with the waste pipe, or on one of the cleaning portals of a waste line trap, commonly found on waste pipes.

The process of removably, but sealably installing the present invention in line, onto a waste pipe and using the invention to provide a warning of a back up of waste in the waste pipe before it backs up and overflows into the building, comprises the following steps: cutting the waste pipe in two locations, parallel to each other but distanced apart the length of the invention; removing the cut piece of the waste pipe and replacing it with the invention; sealably fixing the invention onto the waste pipe in such a way that when the waste flows, it is transported and flows through the invention without any leaks or seepages; and connecting the switching means so that if there is a backup of waste the warning or alarm are triggered there from. Thus, if there is a septic tank overflow or there is a blockage in the waste line anywhere after the location of the invention on the waste pipe, the waste backing up will also back up through the central hollow core extending axially through the inventive device and into the upper portion of the inventive device where it will come in contact with the switching means, close the switching means, and trigger a warning such as an alarm before the waste overflows and spills all over.

Likewise the process of removably, but sealably installing the present invention onto a waste trap commonly found in waste pipes and using the invention to provide a warning of a back up of waste in the waste pipe before it backs up and overflows into the building, comprises the following steps: removing the cap from one of the cleaning portals commonly found on waste traps, on the building side of the trap, and replacing the cap with the invention; sealably fixing the invention onto the cleaning portal of the waste pipe in such a way that when the waste flows, it is transported and flows through the waste trap without any leaks or seepages; and connecting the switching means so that if there is a backup of waste the warning or alarm is triggered there from. Thus, if there is a septic tank overflow or there is a blockage in the waste line anywhere after the location of the inventive device on the waste trap of the waste pipe, the waste backing up will also back up through the central hollow core extending axially through the inventive device and into the upper portion of the inventive device where it will come in contact with the switching means, close the switch, and trigger a warning such as an alarm before the waste overflows and spills all over.

BRIEF DESCRIPTION OF THE DRAWINGS

While the specification concludes with claims which particularly point out and distinctly claim the present invention, it is believed that the present invention will be better understood from the following detailed description taken in conjunction with the accompanying drawings in which like numerals represent identical elements and wherein:

LIST OF ELEMENTS AND THEIR RESPECTIVE IDENTIFYING NUMERALS

| NO | ELEMENT |
|---|---|
| 10 | Early-Detection-and-Advanced-Warning-Waste is-Backing-up Device |
| 20 | Tubular body member |
| 22 | Open lower portion |
| 24 | Closed upper portion |
| 26 | Central Hollow Core |
| 30 | Vent |
| 32 | Balloon |
| 40 | Switching means |
| 50 | Alarm or Warning issuing means |

-continued

| NO | ELEMENT |
|---|---|
| 60 | Communication Means for allowing switching means to communicate with alarm or warning issuing means |
| 70 | Waste Line |
| 72 | Waste trap |
| 80 | Cesspool |
| 90 | Sewer |

DETAILED DESCRIPTION OF THE INVENTION

Figure 1A:
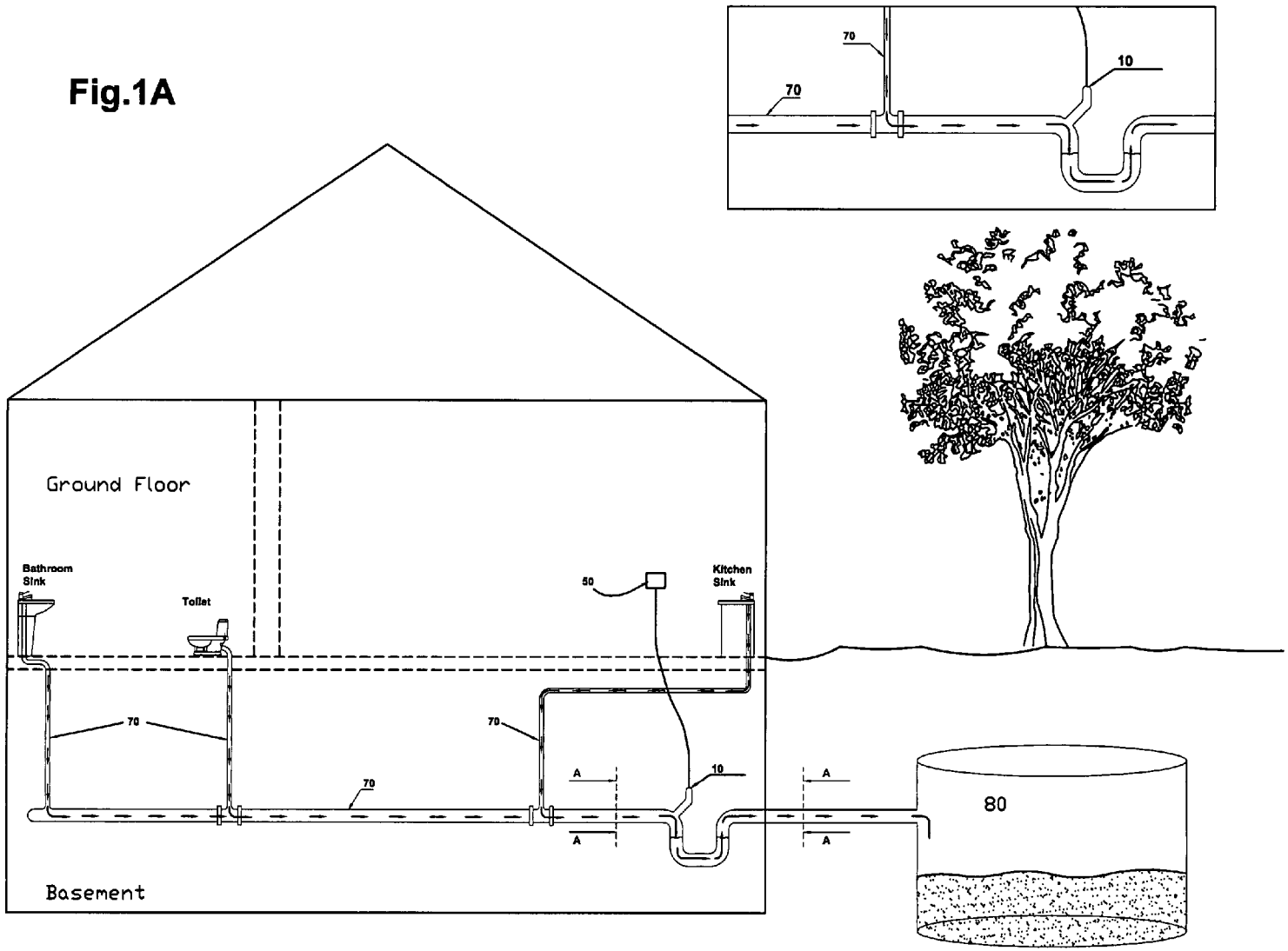
FIG. 1A is an elevational view showing a first preferred embodiment of the inventive device installed on a waste trap of a conventional, residential, single family house, plumbing system ending at and discharging into a cesspool or septic tank.
Figure 1B:
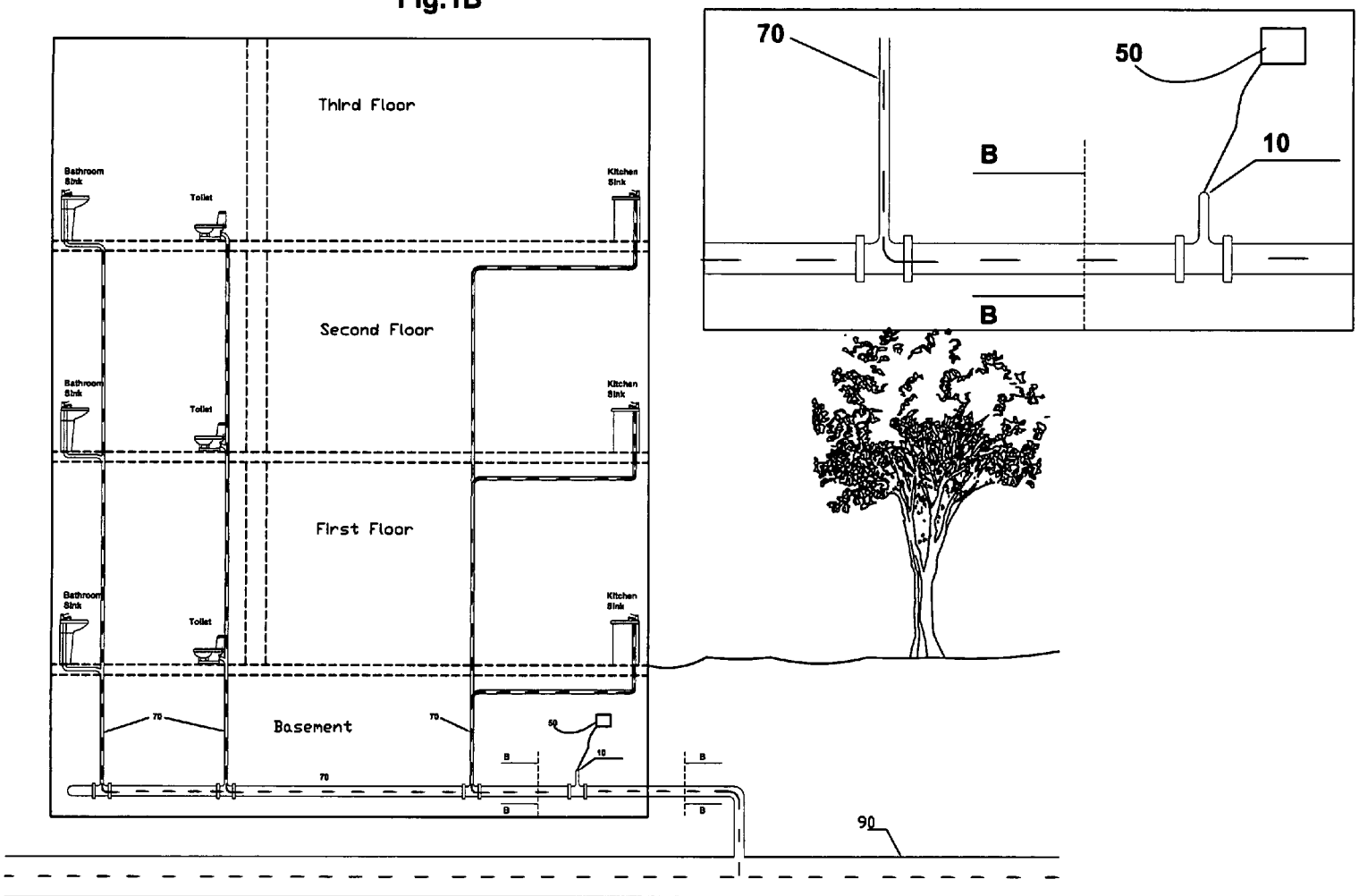
FIG. 1B is an elevational view showing a second preferred embodiment of the inventive device installed in line with a conventional, residential, multi-family dwelling or commercial building, plumbing system ending at and discharging into a public sewer.

Referring more specifically to the drawings, FIGS. 1A and 1B generally depict the inventive device, i.e., the Early-Detection-and-Advanced-Warning-Waste-is-Backing-up Device at 10. It is designed to (i) provide advance warning and prevent waste from backing up and overflowing into the lower level of a building as a result of (a) septic tank or cesspool overflow; or (b) waste line blockage, before the waste actually backs up and spills all over to cause damage and destruction; and (ii) be easily installable into existing plumbing systems of various constructions, without great costs or tremendous expertise, irrespective of whether the construction is old, new, complete or incomplete, thereby providing the occupants and owners of the buildings with a clear advantage in connection with the maintenance of both their waste management conduits and by extension, their buildings.

As can be seen from FIGS. 1A and 1B, indoor plumbing systems collect and transfer building generated waste out of the building and into a cesspool or septic tank 80, or a sewer 90. As the waste is generated at various points within the building, e.g. sinks, toilets, dishwashers, bathtubs, washing machines, etc., it flows through the plumbing/pipe branch lines within the building. These pipe branch lines are connected to secondary pipe branch lines which in turn feed into a main waste line 70, usually at the lower level of the building. The waste leaves the point it is generated at, travels downwardly through the pipe branch lines and eventually is transported through the main waste line 70 and the waste trap 72, out of the building and into a cesspool, septic tank 80, or a public sewer system 90.

The Early-Detection-and-Advanced-Warning-Waste-is-Backing-up Device 10, as can be seen from FIGS. 1A and 1B is removably and sealably inserted and fixed either directly and in line with the main waste line 70, or alternatively onto the main waste trap 72, located almost at the end of the main waste line, right before it exits the building to enter a cesspool 80, or a sewer 90. Thus, if there is waste back up in the main waste line 70, as a result of the cesspool or septic tank 80 becoming filled beyond capacity, or as a result of the main waste line 70 becoming blocked anywhere close to the point where waste exits from the building, such waste will also back up right into the Early-Detection-and-Advanced-Warning-Waste-Is Backing-up device 10, and trigger a warning that the waste is backing up before it actually overflows and spills all over. Such warning will provide a window of opportunity to either pump the cesspool or septic tank, or remove the blockage before any further backing up or damage can be caused.

However, the installation of the Early-Detection-and-Advanced-Warning-Waste-is-Backing-up Device 10 is not restricted to just the main waste line 70 or the main waste trap 72. It can also be removably and sealably inserted and fixed either directly and in line with any other of the plumbing pipe branches of a building, or alternatively onto any of the other waste traps commonly found in a plumbing system of a building. Thus, it can be installed on waste traps associated with bathtubs, toilets, sinks and wherever else the prevention of a backup of waste, and the damage normally associated with such a backup, must be necessarily and absolutely avoided.

The Early-Detection-and-Advanced-Warning-Waste-is-Backing-up Device 10 comprises a tubular body member 20 having an open lower portion 22, a central hollow core 26 extending axially there through, a closed upper portion 24, a vent 30, switching means 40, means for issuing a warning or an alarm 50, and means for allowing the switching means to communicate with the warning or alarm issuing means 60. It may be formed of any plastic or metal materials, or a combination thereof, that will allow the plumbing of a building to continue to meet national and local code requirements for building plumbing, even after the Early-Detection-and-Advanced-Warning-Waste-is-Backing-up Device 10 is installed or inserted thereon. In the preferred embodiment of the Early-Detection-and-Advanced-Warning-Waste-is-Backing-up Device 10, it is formed of just polyvinyl chloride, i.e., PVC.

Figure 2:
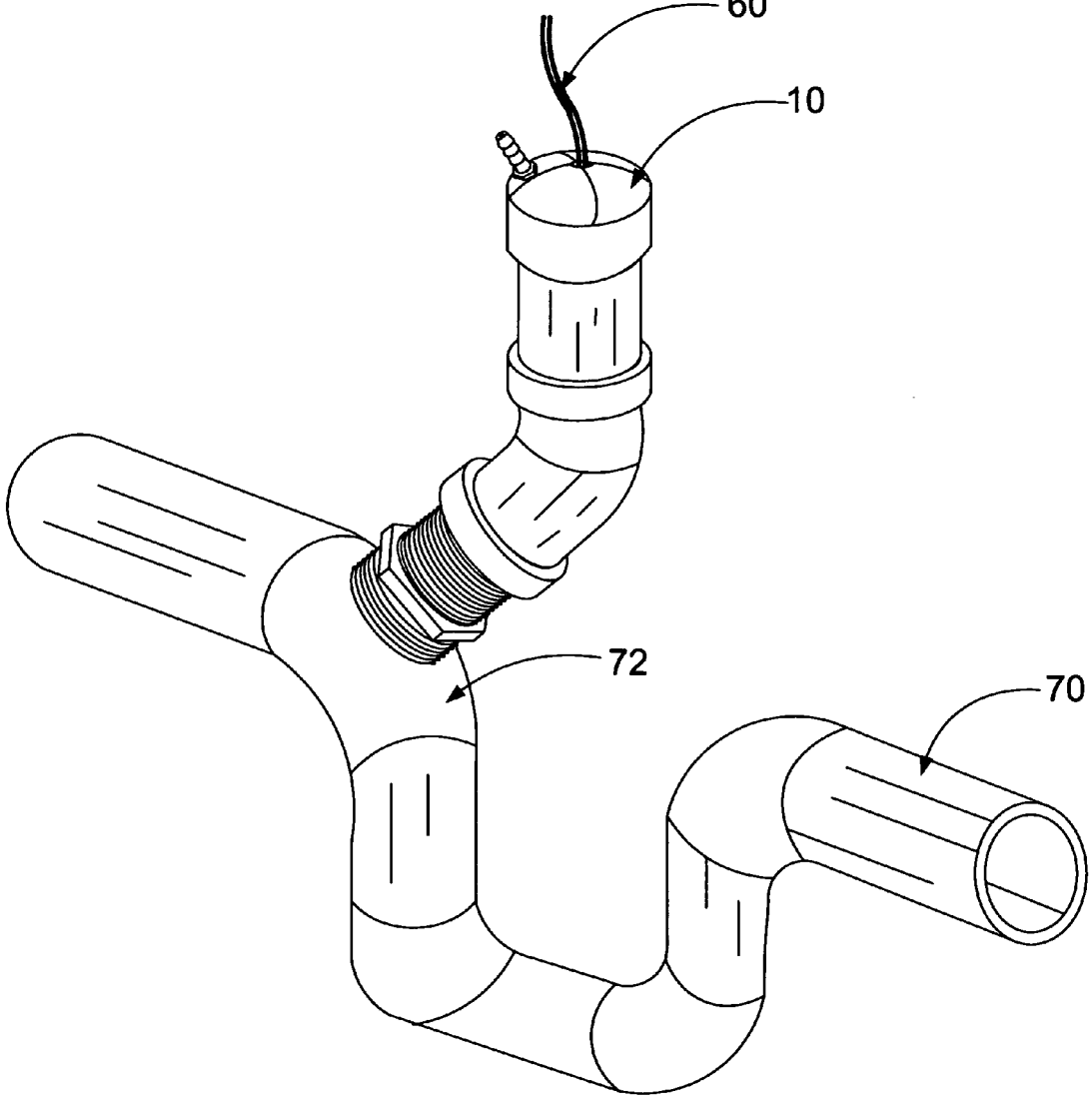
FIG. 2 is a perspective view of the inventive device installed on the waste trap of the conventional, residential, single family house, plumbing system of FIG. 1A, taken along line A-A'.
Figure 3:
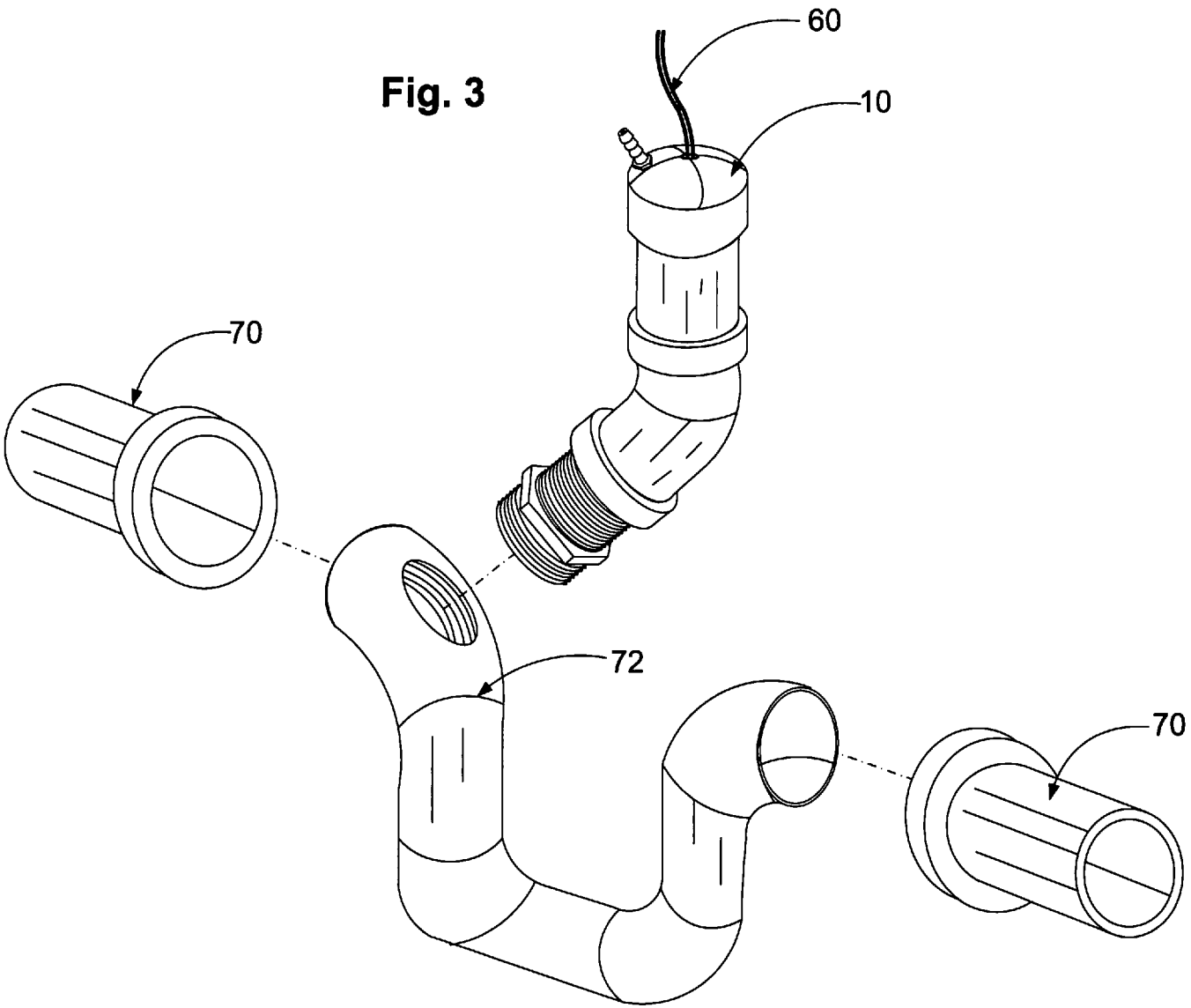
FIG. 3 is an exploded view of the waste trap in the waste line and the inventive device of FIG. 2.
Figure 7:
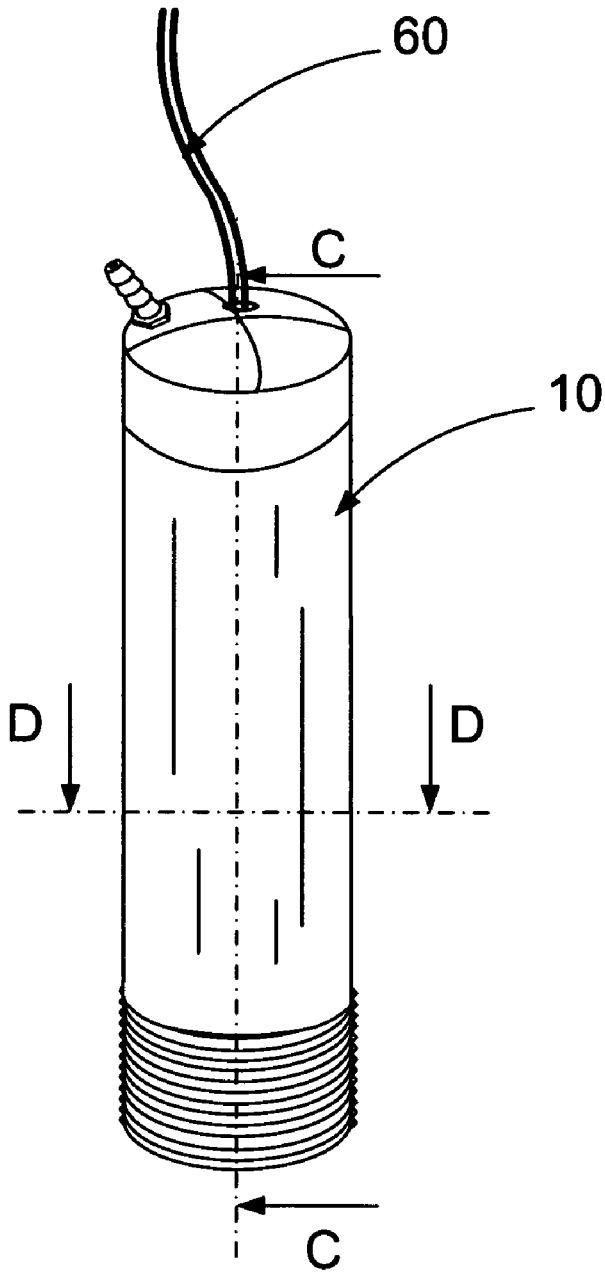
FIG. 7 is a perspective of one embodiment of the inventive device.
Figure 7A:
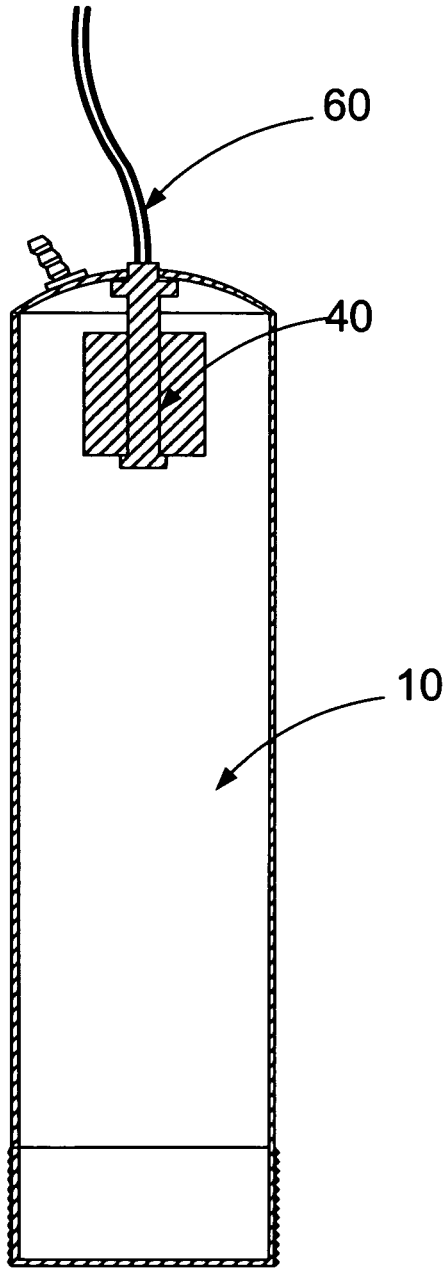
FIG. 7A is a section view of the inventive device taken along line C-C' of FIG. 7 showing the interior arrangement of the vent and switching means within the tubular body of the inventive device.
Figure 7B:
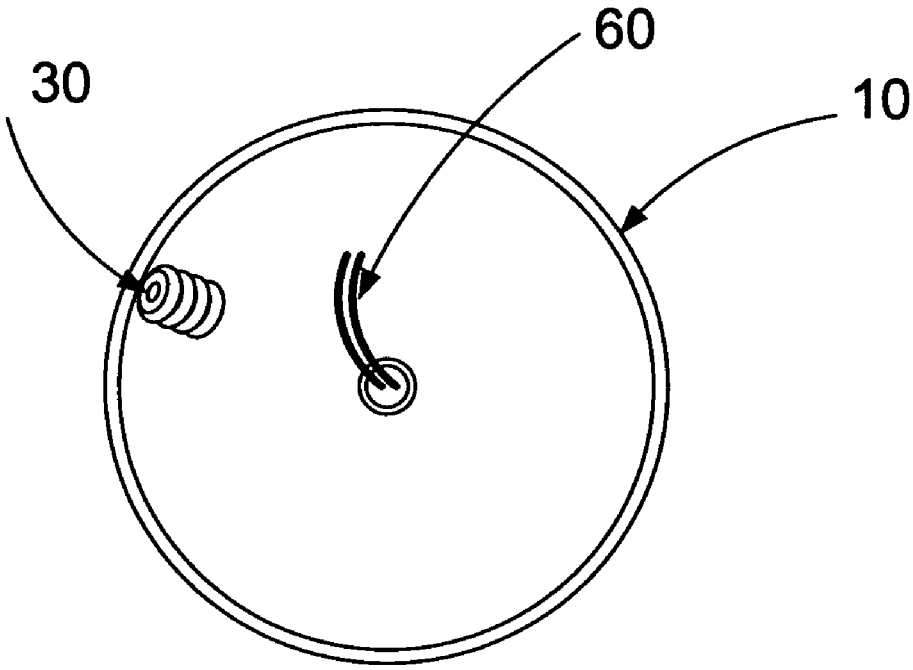
FIG. 7B is a top view of the inventive device of FIG. 7.
Figure 7C:
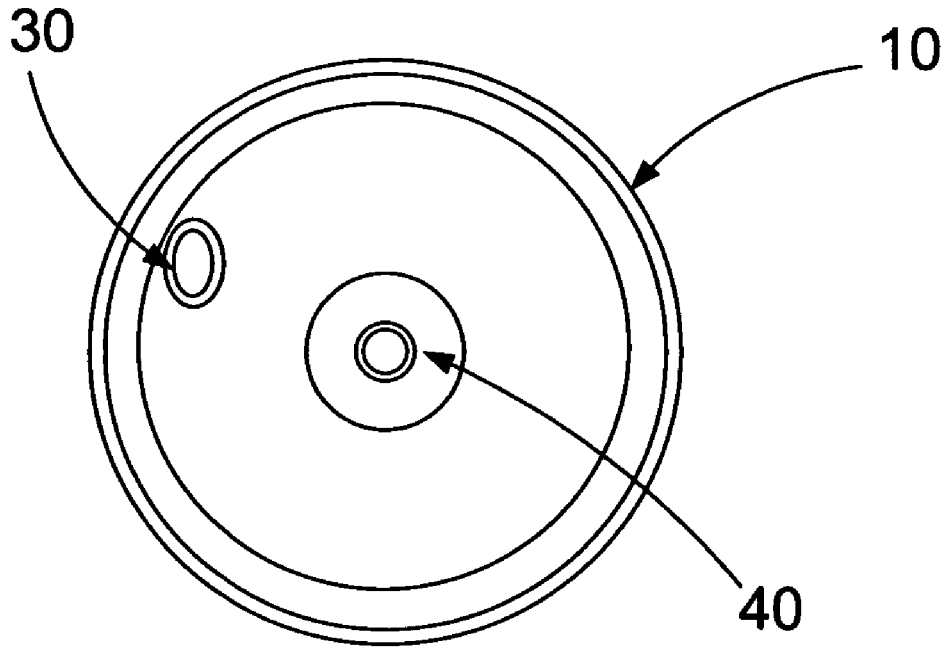
FIG. 7C is a bottom view of the inventive device of FIG. 7.
Figure 7E:
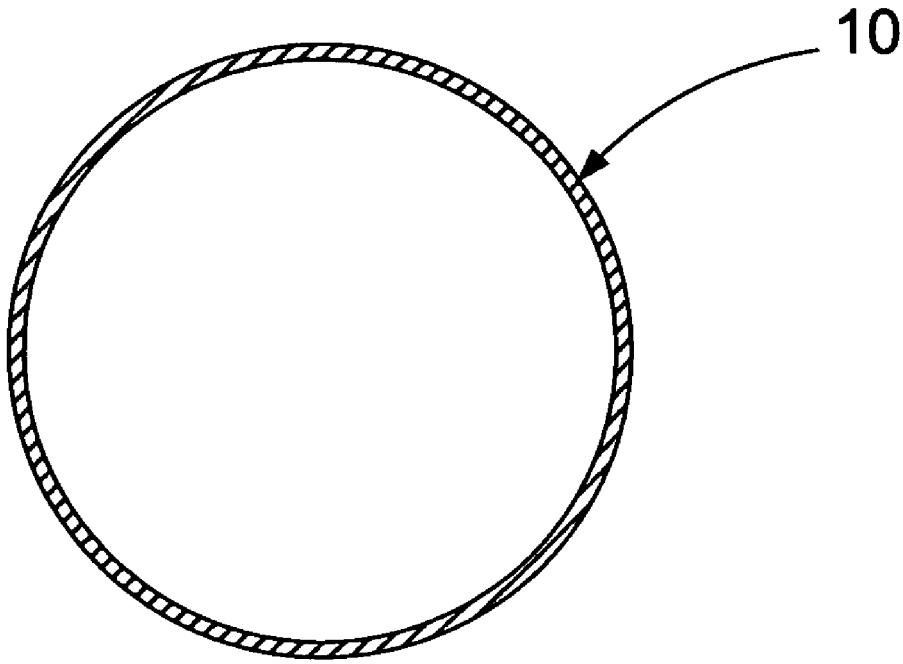
FIG. 7E is a sectional view of the inventive device taken along line D-D' of FIG. 7 showing the lower open portion of the inventive device.
Figure 8:
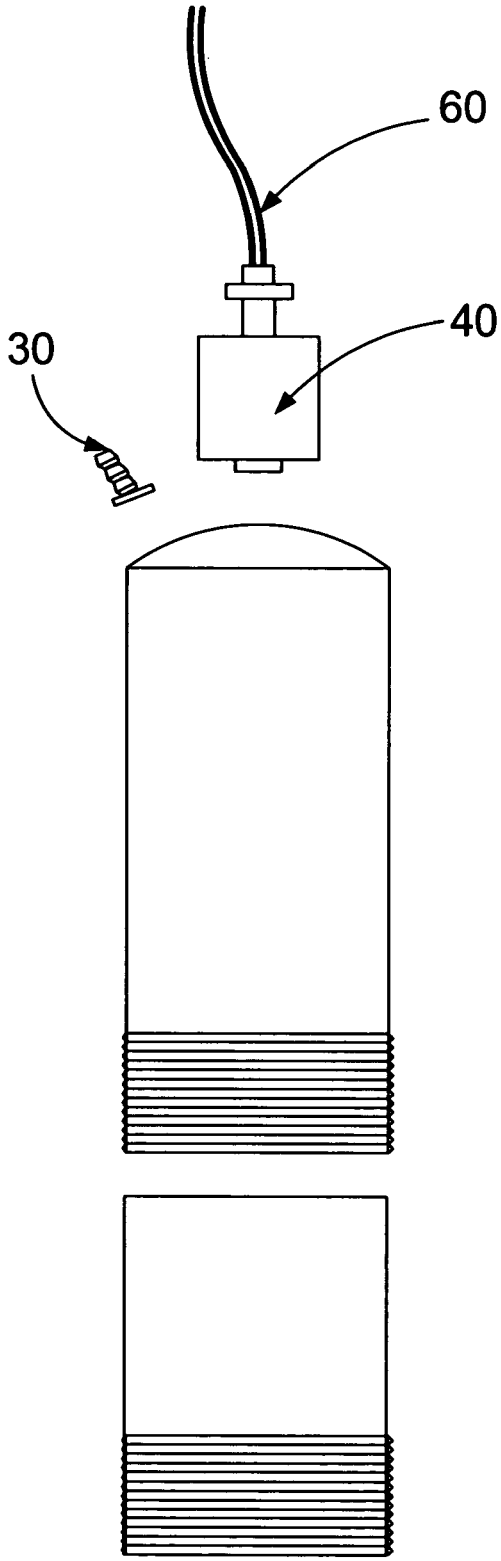
FIG. 8 is an exploded plan view of the inventive device's tubular body member comprising at least two components.
Figure 9:
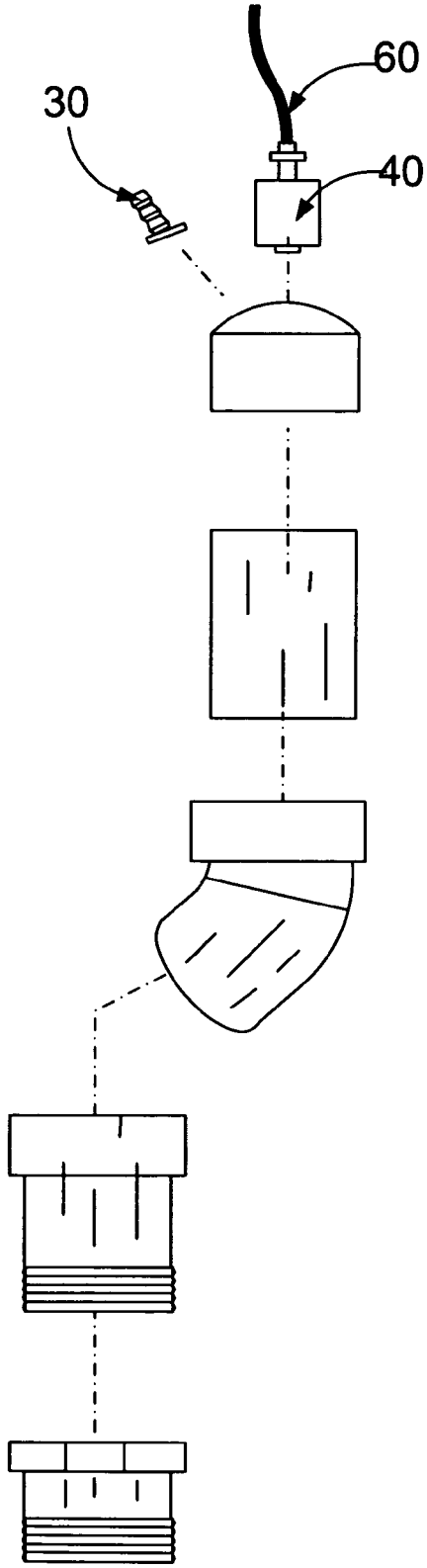
FIG. 9 is an exploded perspective view of the inventive device's tubular body member comprising multiple components.

As can be seen from FIGS. 7, 8, 9, and 11 the tubular body member 20 can be straight or slightly bent. FIGS. 2, 3, and 9 show the tubular body member 20 as being slightly bent. In the preferred bent embodiment for the tubular body member 20, the angle of such bend is approximately 22°. The bend allows for easy installation of the Early-Detection-and-Advanced-Warning-Waste-is-Backing-up Device 10 onto a waste trap, whose portals are molded at an angle, while simultaneously provides for a vertical alignment of the remaining components of the Early-Detection-and-Advanced-Warning-Waste-is-Backing-up Device 10. Particularly when a vertical alignment is necessary for the proper function of the components thereof, as for example when the components are less sensitive, first generation components.

Figure 4:
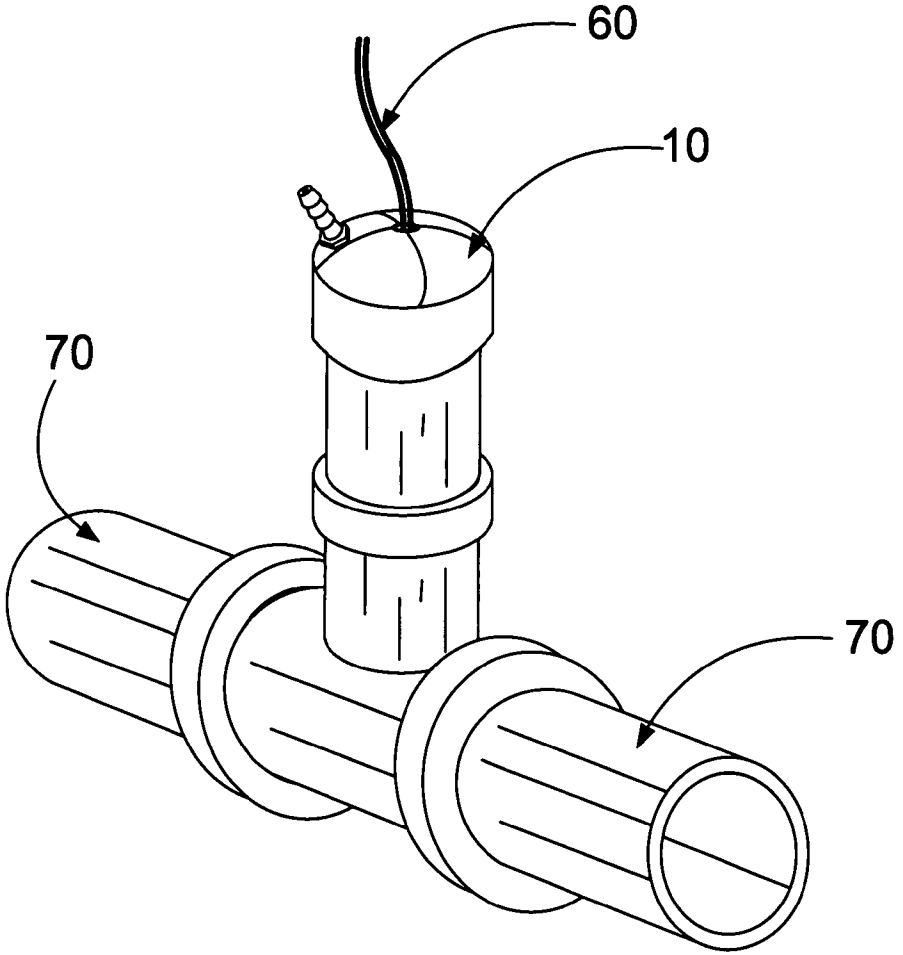
FIG. 4 is a perspective view of the inventive device installed in line with the waste line of the conventional, residential, multi-family dwelling or commercial building, plumbing system of FIG. 1B, taken along line B-B'.
Figure 5:
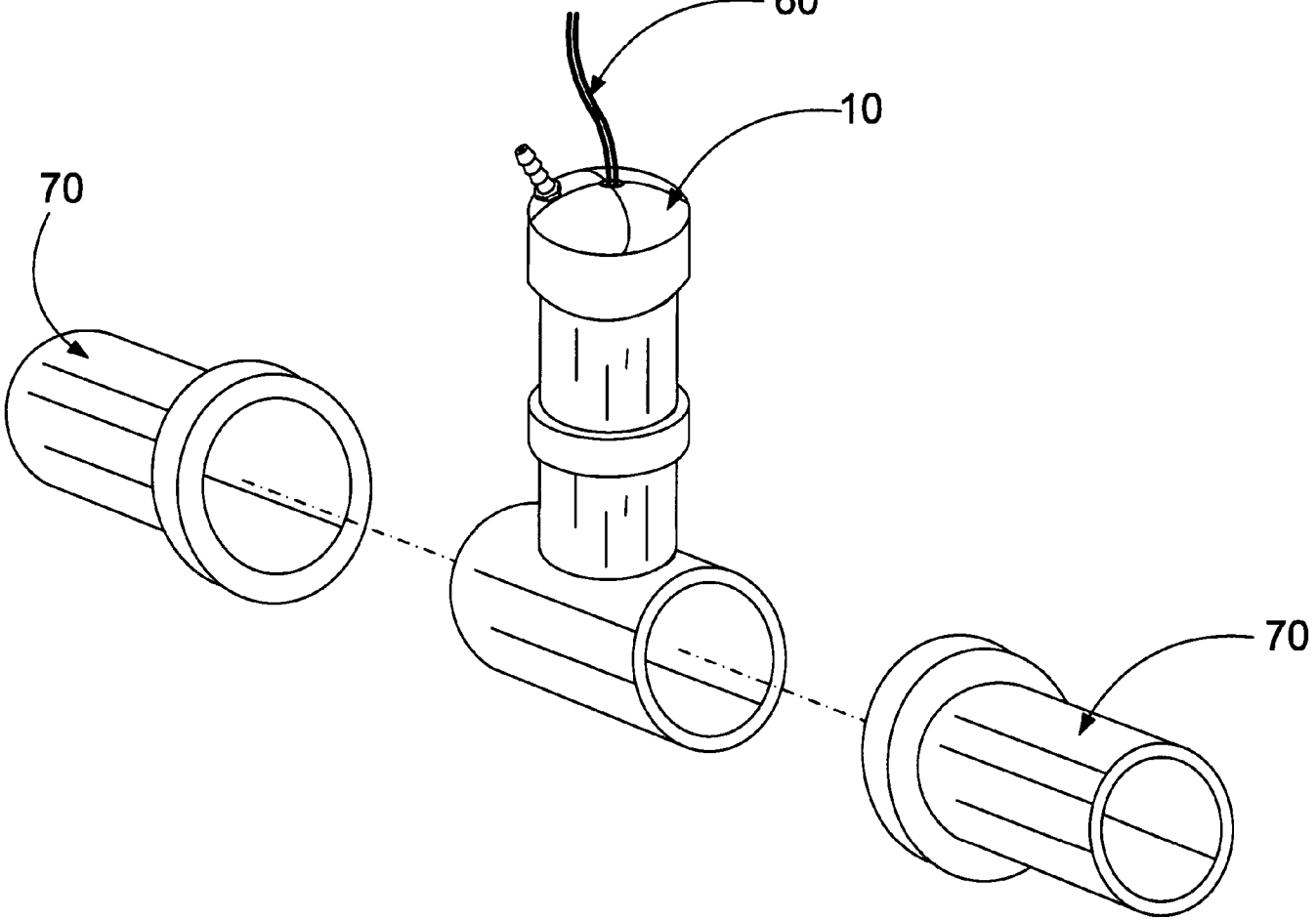
FIG. 5 is an exploded view of the waste line and the inventive device of FIG. 4.
Figure 11:
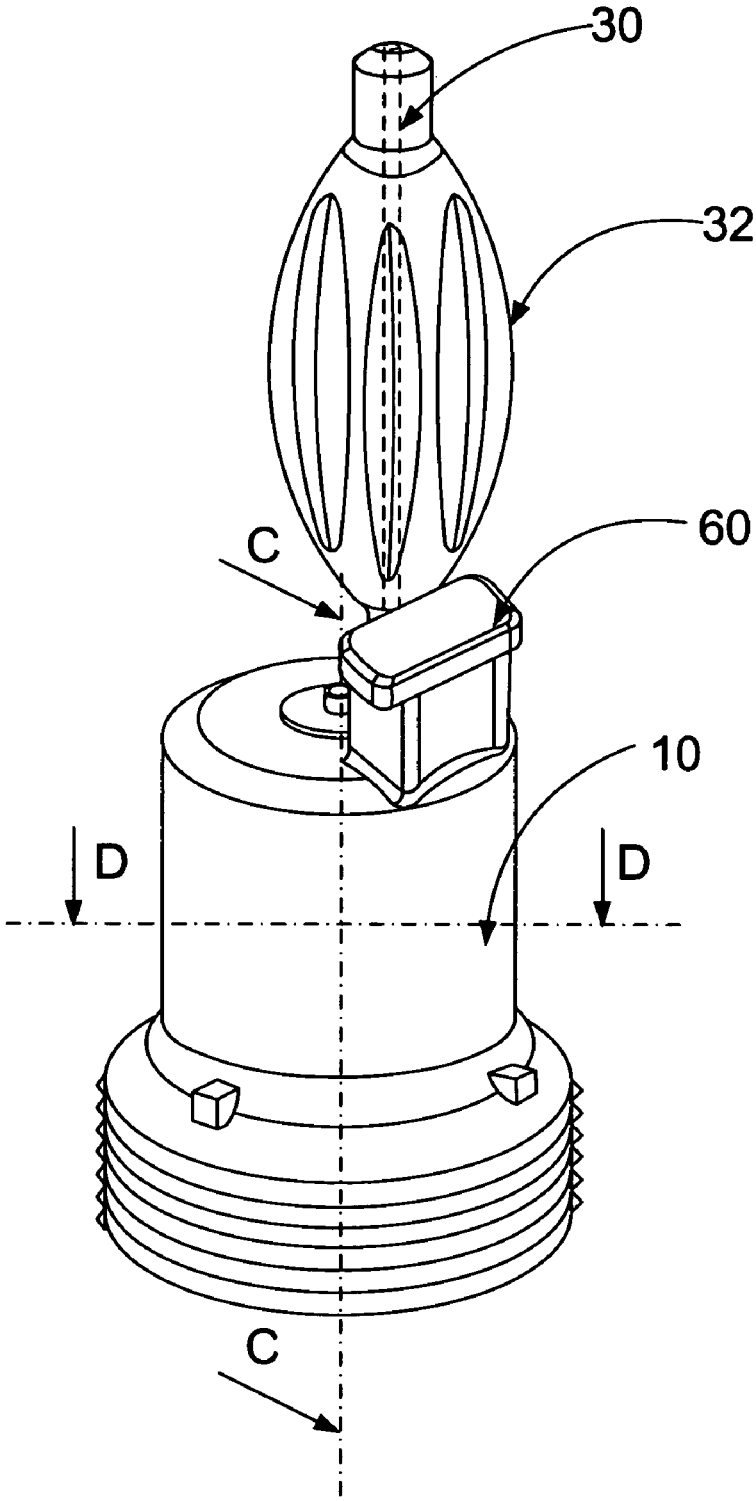
FIG. 11 is a perspective of yet another embodiment of the inventive device.
Figure 11A:
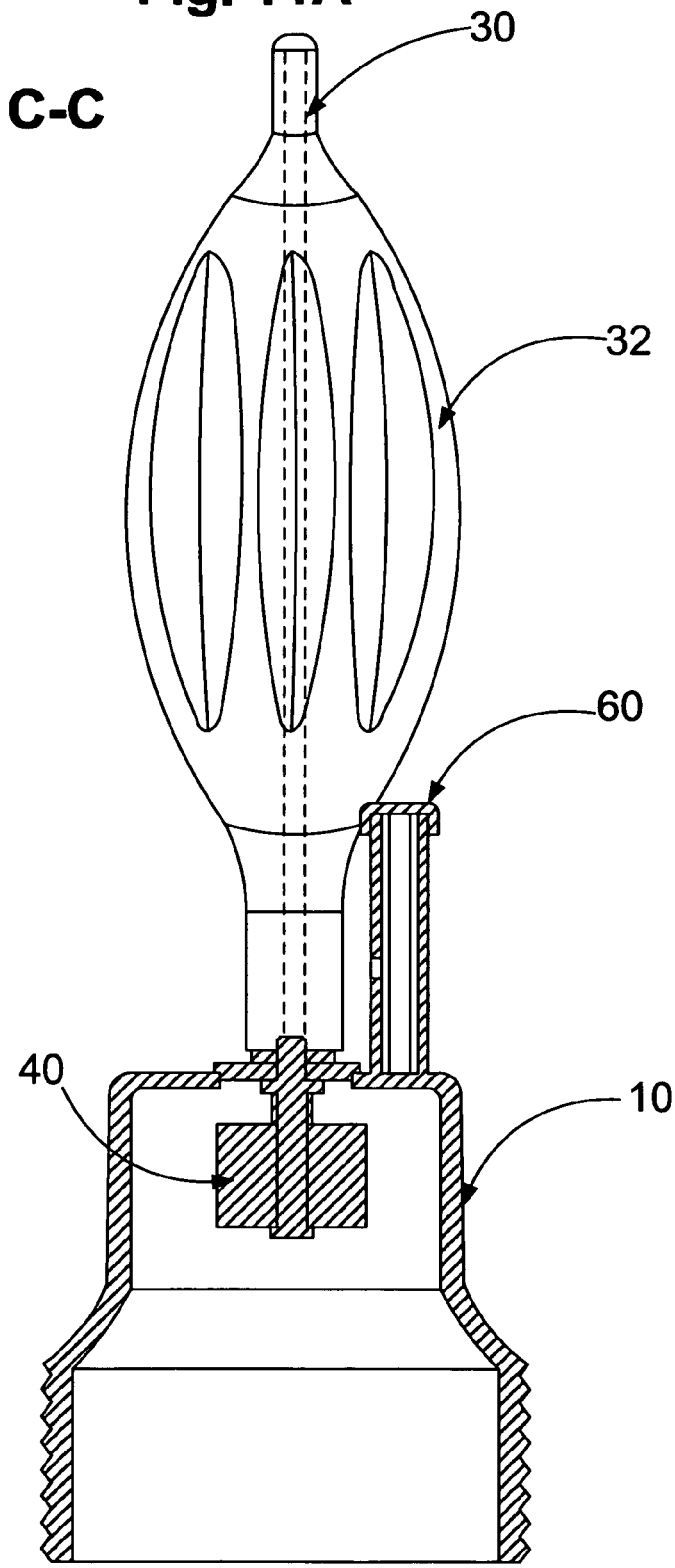
FIG. 11A is a section view of the inventive device taken along line C-C' of FIG. 11 showing the interior arrangement of the vent and switching means within the tubular body of the inventive device.
Figure 11B:
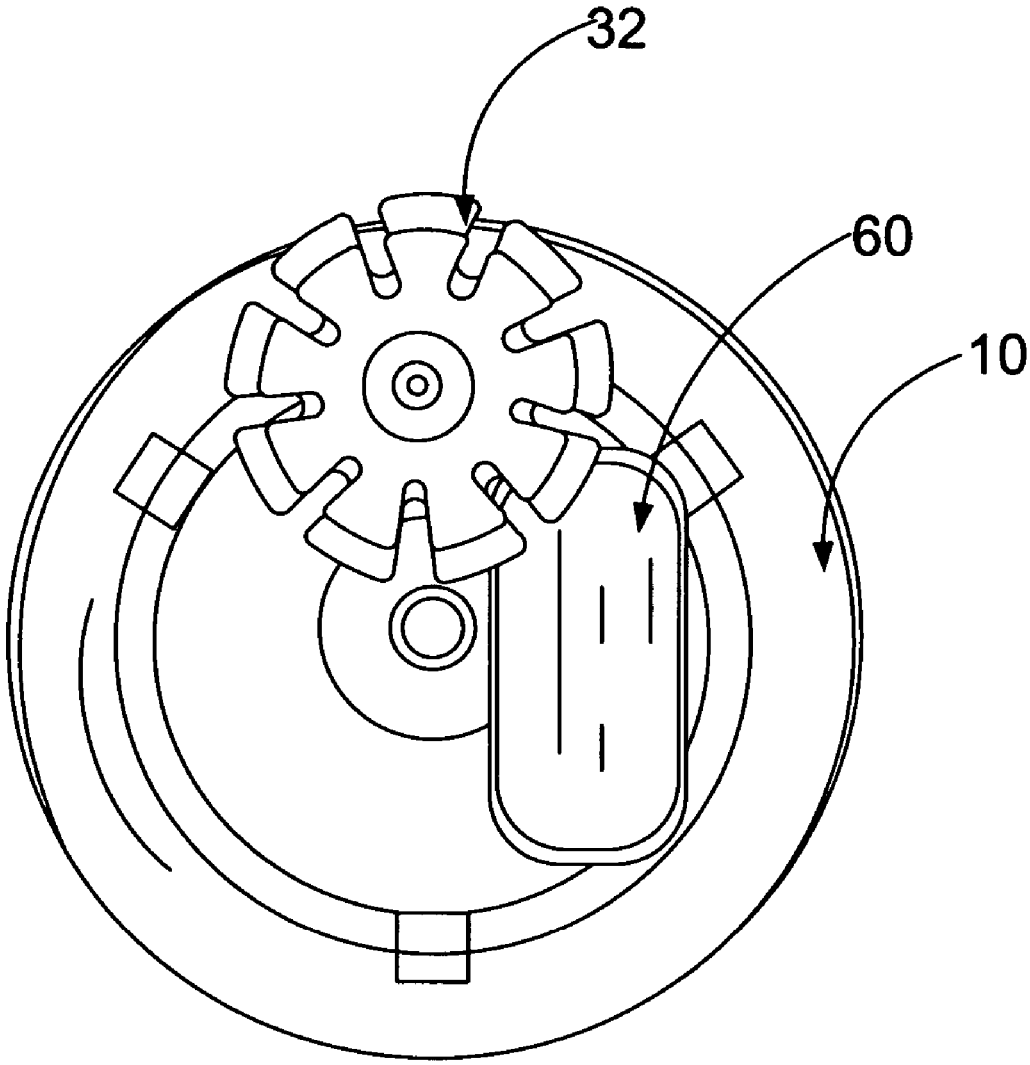
FIG. 11B is a top view of the inventive device of FIG. 11.
Figure 11C:
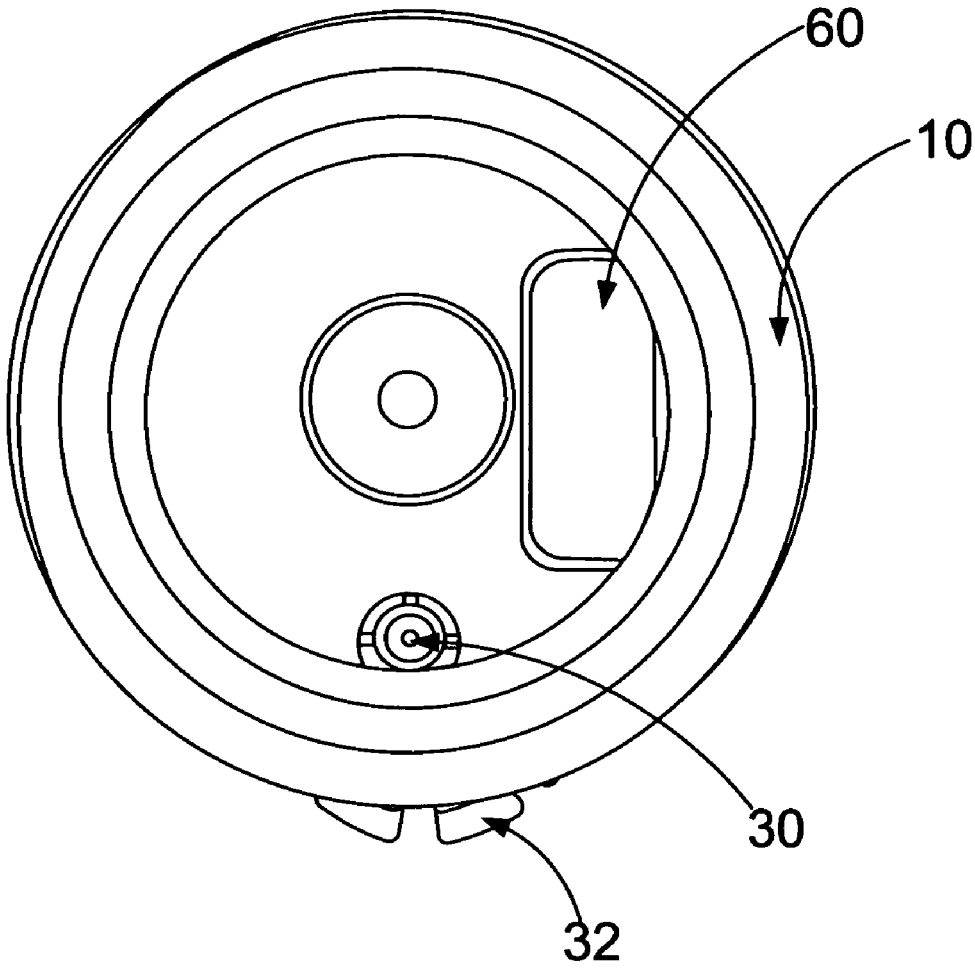
FIG. 11C is a bottom view of the inventive device of FIG. 11.
Figure 11E:
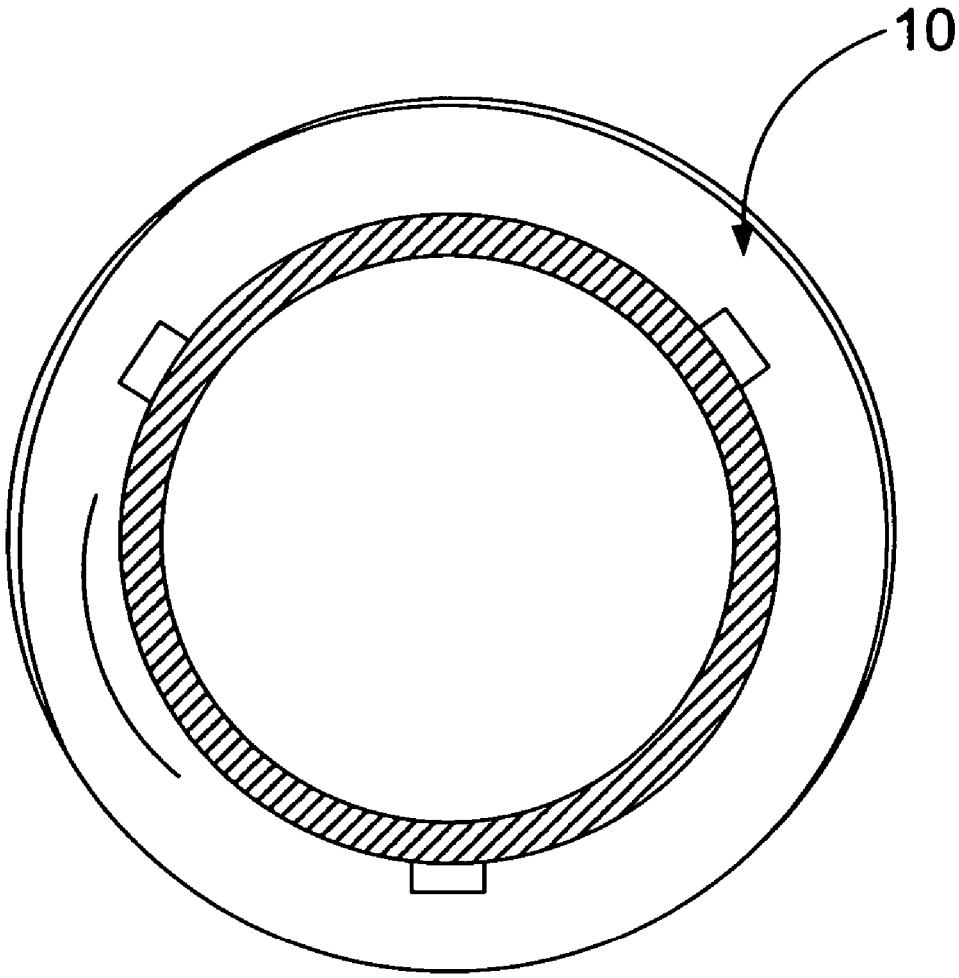
FIG. 11E is a sectional view of the inventive device taken along line D-D' of FIG. 11 showing the lower open portion of the inventive device.

On the other hand, when a bend in the tubular body is not necessary to facilitate installation, as for example when the Early-Detection-and-Advanced-Warning-Waste-is-Backing-up Device 10 is inserted in line with a waste pipe, as is shown in FIG. 4, or when the components of Early-Detection-and-Advanced-Warning-Waste-is-Backing-up Device 10 are so sensitive that they do not necessarily need to be vertically aligned as is shown in FIG. 11, then the tubular body member 20 can have a straight body.

Figure 6:
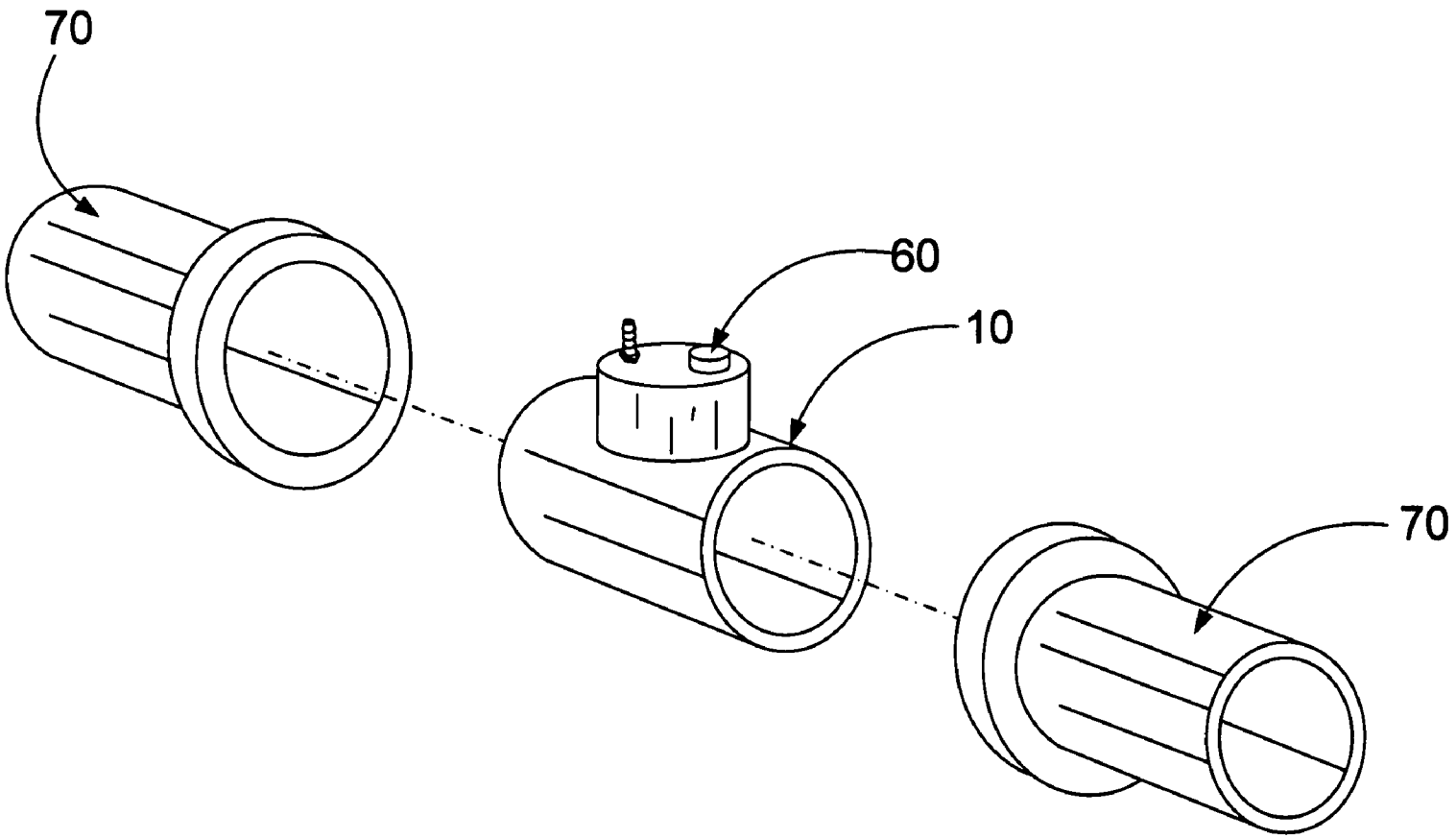
FIG. 6 is an exploded view of the waste line and an alternative embodiment of the inventive device of FIG. 4.
Figure 10:
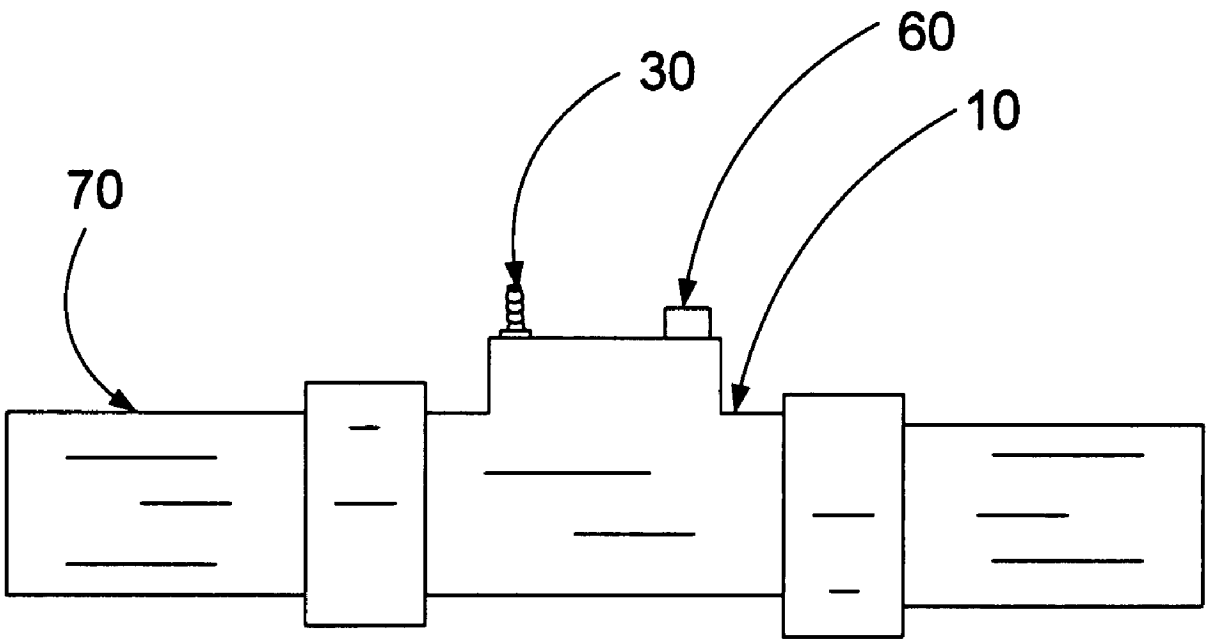
FIG. 10 is a plan view of the embodiment of the inventive device shown in FIG. 6.

Finally, the tubular body 20 can also have a composite shape, similar to that shown in FIGS. 6 and 10 where the lower open part of the tubular body is configured to be inserted and sealably fitted in line with a waste pipe line, without the use of additional t-shaped piping as shown in FIGS. 3 and 4; while the remaining tubular body 20 is configured to maintain the components in a vertical alignment.

It is clear then, from the above that the shape of the tubular body 20 is not limited to any particular configuration. It can be shaped in any way, shape or form, so long as that way, shape or form permits the tubular body 20 to be inserted in line, in a waste line pipe 70, or be connected onto a waste trap 72, on the one hand; and allows for the proper functioning of both the waste pipe line and the remaining components of the Early-Detection-and-Advanced-Warning-Waste-is-Backing-up Device 10, on the other hand.

Similarly, the dimensions of the tubular body 20, i.e., the diameter and the height, are not limited either. The diameter of the tubular body 20 can be sized with any dimension, so long as such dimension allows for the easy, secure, sealable, and leak free installation of the Early-Detection-and-Advanced-Warning-Waste-is-Backing-up Device 10 onto the waste pipe line 70, or the waste trap 72. The height of the tubular body 20 can be such that it is sufficiently high to lift the remaining components of the Early-Detection-and-Advanced-Warning-Waste-is-Backing-up Device 10 out of the normal flow path of the waste being transported through the waste pipe line 70, out of the building, preferably only slightly above the upper inner surface of the waste line pipe; but sufficiently low so as to provide for their exposure to any possible backup of waste in the waste pipe line 70 or waste trap 72 and provide a warning or alarm sufficiently timely so as to prevent the overflow and backup of waste right into the building.

Thus, in the preferred embodiments shown in FIGS. 7, 7A-7E, 8 and 11 the diameter of the tubular body member 20 is approximately four inches (4") because the ports of the waste trap 72 are designed, by code to accept fittings that are approximately 4" wide. On the other hand, if the Early-Detection-and-Advanced-Warning-Waste-is-Backing-up Device 10 is to be installed on waste trap ports that are smaller or larger than 4" in diameter, then clearly the dimensions of the tubular body member 20 will also be changed to allow it to be accommodated and be sealably fixed into the new size ports.

Similarly in the preferred embodiments shown in FIGS. 7, 7A-7E, 8, 10 and 11 the height of the tubular body member 20 varies from relatively short to relatively long.

The tubular body member 20 can be a single unitary molded piece as depicted in FIGS. 7 and 11. Or as can be seen in FIG. 8 and FIG. 9 it can comprise two or more components. Its open lower portion 22 is configured so that the Early-Detection-and-Advanced-Warning-Waste-is-Backing-up Device 10 can be removably, but sealably, fixed onto a waste line pipe, either in line with the waste pipe, or on the ports of a waste line trap, commonly found in line with waste pipes. Accordingly, in the preferred embodiments of the Early-Detection-and-Advanced-Warning-Waste-is-Backing-up Device 10, the lower outer surface of the open lower portion 22 of the tubular body member 20 is provided with threads. Alternatively, the lower outer surface of the open lower portion 22 can be configured without threads so that it frictionally fits and seals into the waste line pipe 70 or the waste trap 72.

As discussed above, the tubular body member 20 also has a central hollow core 26 and an upper closed portion 24. The hollow core 26 extends axially through the tubular body member 20. The dimensions of the hollow core depend on the thickness of the walls of the tubular body member 20. However, such dimensions are not critical as the only purpose of the hollow core 26 and the upper closed portion 24 is to allow the tubular body member to act as a housing for the remaining components of the Early-Detection-and-Advanced-Warning-Waste-is-Backing-up Device 10 and as a conduit for the waste backing up in the waste pipe line, while simultaneously preventing the leaching of noxious waste gases into the surrounding building environment.

The upper closed portion 24 bears and supports a vent 30 and a switching means 40. The switching means 40 is fixedly secured on the upper closed portion 24 and extends downward from said upper portion into the hollow core 26 of the tubular body member 20, so that it, in effect is surrounded and shielded from the outside environment by the walls of the tubular body member 20. In one of the preferred embodiments as shown in FIG. 9, the switching means 40 is a polypropylene float switch. However, the switching means is by no means limited to just a polypropylene float switch. One skilled in the art will recognize that the switching means can be any switch currently available or might be available in the future, in which a component thereof, as for example a float or a sensor, can respond to the rise of liquid waste inside the tubular body member 20 to close a circuit and provide a signal.

The switching means 40 is provided with communication means 60 for communicating with an alarm or warning issuing means 50. The communication means 60 can be wiring, or in today's technological wire could be a wireless communication device. The means for issuing an alarm or warning 50 can be something as simple as a red lightbulb, a strobe light, a siren or a modern day display device. When the float or sensor of the switching means 40 responds to the rise of liquid waste inside the tubular body member 20 to close a circuit and provide a signal, the signal travels along the communication means 60 to arrive at the alarm or warning issuing means 50, whereupon an action is immediately generated, i.e. a siren goes off, or a light begins flashing, or a computer screen or home alarm is activated remotely to warn of the upcoming waste backup and provide a window of opportunity to the user to clear up the problem.

The vent 30 is provided on the upper closed portion 24 to allow the air displaced by the rising waste inside the tubular body member 20 to exit to the outside. Absence of the vent and the displacement of air by the rising waste will render the Early-Detection-and-Advanced-Warning-Waste-is-Backing-up Device 10 useless, as it will prevent the waste from reaching the switching means 40.

The vent 30 can optionally be outfitted with a brass male fitting and a very long tube having a first end and a second end. The first end is removably fixed onto the brass male fitting and the second end brought to the outside of the building. This in essence connects the vent to the outside of the building, and allows the air displaced by the rising waste within the tubular body member 20, to escape into the outside without causing any unpleasant odors in the building. Or in the alternative, the vent can be outfitted with a balloon type cover such as the one shown in FIG. 11 which will allow the displaced air to expand into the balloon but prevent it from escaping into the building, while at the same time eliminating the need for a long tube extending to the outside.

The process of removably, but sealably installing and fixing the Early-Detection-and-Advanced-Warning-Waste-is-Backing-up Device 10 in line with a waste pipe line 70 and using it to provide a warning of a back up of waste in the waste pipe before it backs up and overflows into the building, comprises the following steps: (i) cutting the waste pipe 70 in two locations, parallel to each other but distanced apart the length of a standard T-pipe; (ii) removing the cut piece of the waste pipe line and replacing it with the T-pipe; (iii) sealably fixing the T-pipe onto the waste pipe line in such a way that when the waste flows, it is transported and flows through the T-pipe, without any leaks or seepages; (iv) removably, but sealably installing and fixing the Early-Detection-and-Advanced-Warning-Waste-is-Backing-up Device 10, as set forth in FIG. 11 or FIG. 4 into the T-pipe; (v) and connecting the switching means 40 via the communication means 60 to the Alarm Issuing Means 50, so that if there is a backup of waste, a warning or alarm is triggered there from. Thus, if there is a septic tank overflow or there is a blockage in the waste line anywhere after the position of the Early-Detection-and-Advanced-Warning-Waste-is-Backing-up Device 10 on the waste pipe line, the waste backing up will also back up through the central hollow core 26 and into the upper portion of the Early-Detection-and-Advanced-Warning-Waste-is-Backing-up Device 10 where it will come in contact with the switching means 40, trigger the detecting circuit and provide an electric signal to the alarm issuing means 50, where a warning such as an alarm or siren or otherwise is sounded to provide an opportunity to correct the problem, before the waste overflows and spills all over.

The process of removably, but sealably installing and fixing the Early-Detection-and-Advanced-Warning-Waste-is-Backing-up Device 10 embodied in FIG. 6 and FIG. 10 in line with a waste pipe line 70 and using it to provide a warning of a back up of waste in the waste pipe before it backs up and overflows into the building, comprises the following steps: (i) cutting the waste pipe 70 in two locations, parallel to each other but distanced apart the length of the lower portion of the t-shaped Early-Detection-and-Advanced-Warning-Waste-is-Backing-up Device 10; (ii) removing the cut piece of the waste pipe line and replacing it with the T-shaped Early-Detection-and-Advanced-Warning-Waste-is-Backing-up Device 10; (iii) sealably fixing the T-shaped Early-Detection-and-Advanced-Warning-Waste-is-Backing-up Device 10 onto the waste pipe line in such a way that when the waste flows, it is transported and flows through the T-shaped Early-Detection-and-Advanced-Warning-Waste-is-Backing-up Device 10, without any leaks or seepages; and (iv) connecting the switching means 40 via the communication means 60 to the Alarm Issuing Means 50, so that if there is a backup of waste, a warning or alarm is triggered there from. Thus, if there is a septic tank overflow or there is a blockage in the waste line anywhere after the position of the Early-Detection-and-Advanced-Warning-Waste-is-Backing-up Device 10 on the waste pipe line, the waste backing up will also back up through the central hollow core 26 and into the upper portion of the T-shaped Early-Detection-and-Advanced-Warning-Waste-is-Backing-up Device 10 where it will come in contact with the switching means 40, trigger the detecting circuit and provide an electric signal to the alarm issuing means 50, where a warning such as an alarm or siren or otherwise is sounded to provide an opportunity to correct the problem, before the waste overflows and spills all over.

Likewise the process of removably, but sealably installing the Early-Detection-and-Advanced-Warning-Waste-is-Backing-up Device 10 onto a waste trap 72 commonly found in waste pipes and using it to provide a warning of a back up of waste in the waste pipe 70 before it backs up and overflows into the building, comprises the following steps: (i) removing the cap from the cleaning portal commonly found on waste traps and closer to the building, i.e., the building side of the waste trap; (ii) replacing the removed cap with the Early-Detection-and-Advanced-Warning-Waste-is-Backing-up Device 10; (iii) removably and sealably fixing the Early-Detection-and-Advanced-Warning-Waste-is-Backing-up Device 10 onto the cleaning portal of the waste pipe in such a way that when the waste flows, it is transported and flows through the waste trap 72 without any leaks or seepages; and (iv) connecting the switching means 40 via the communication means 60 to the Alarm Issuing Means 50, so that if there is a backup of waste, a warning or alarm is triggered there from. Thus, if there is a septic tank overflow or there is a blockage in the waste line anywhere after the position of the Early-Detection-and-Advanced-Warning-Waste-is-Backing-up Device 10 on the waste trap, the waste backing up will also back up through the central hollow core 26 and into the upper portion of the Early-Detection-and-Advanced-Warning-Waste-is-Backing-up Device 10, where it will come in contact with the switching means 40, trigger the detecting circuit and provide an electric signal to the alarm issuing means 50, where a warning such as an alarm or siren or otherwise is sounded to provide an opportunity to correct the problem, before the waste overflows and spills all over.

It is clear then from all of the above, that the Early-Detection-and-Advanced-Warning-Waste-is-Backing-up Device 10 achieves all of the objectives set forth herein above including providing for early detection and advanced warning that waste is backing up in the main waste line of a building, before the waste overflows and spills all over the lower levels of the building. It prevents costly damage to a building, as a result of waste backing up in the main waste line, overflowing, and spilling out into the lower levels of the building. It provides a window of opportunity for the elimination or removal of the waste blockage in the main waste line, or the pumping of the septic tank and/or cesspool, before the waste backs up, overflows and spills out and all over the lower levels of the building. It comprises an apparatus and method for the early detection and advance warning that waste is backing up in the main waste line of a building, that are easily installable into existing plumbing systems of various constructions, without great costs or tremendous expertise, irrespective of whether the construction is old, new, complete or incomplete. Further, it gives the occupants, maintenance engineers, and owners of the building a clear advantage in connection with the maintenance of both their waste management conduits and by extension, their buildings. Finally, it prevents buildings from being exposed to the damage caused by overflowing, backed-up waste and helps manage waste backing up in a main waste line in a manner that will minimize both building maintenance costs and insurance fees.

While particular embodiments of the invention have been illustrated and described in detail herein, they are provided by way of illustration only and should not be construed to limit the invention. Since certain changes may be made without departing from the scope of the present invention, it is intended that all matter contained in the above description, or shown in the accompanying drawings be interpreted as illustrative and not in a literal sense. Practitioners of the art will realize that the sequence of steps and the embodiments depicted in the figures can be altered without departing from the scope of the present invention and that the illustrations contained herein are singular examples of a multitude of possible depictions of the present invention.

We claim:

1. A device for the early detection and advanced warning that waste is backing up in a waste pipe line comprising:

a tubular body member having an open lower portion, a central hollow core extending axially there through, and a closed upper portion, said open lower portion dimensionally sized and configured to be removably yet sealably fitted and fixed into the waste pipe line, and said closed upper portion being provided with a vent;

switching means fixedly secured on said upper closed portion and extending from said upper closed portion into said hollow core so that it is surrounded by and housed within said tubular body member;

alarm issuing means installed in a remote location distanced away from the installation location of said tubular body but positioned for easy access and viewing; and communications means connecting said switching means to said alarm issuing means so that when the switching means responds to the rise of liquid waste inside said tubular body member as a result of waste backup in the waste pipe line, it closes a circuit and sends a signal along said communication means to said alarm issuing means, to generate an alarm and provide a window of opportunity to clear up the waste back up.

2. The device according to claim 1, wherein said vent comprises a fitting and a relatively long tube having a first end and a second end, said fitting fixedly attached to said vent, said first end of said relatively long tube being removably fixed onto said fitting and said second end located outside of the building to allow air displaced by the rising waste within said tubular body member during a waste backup, to escape into the outside without causing any unpleasant odors in the building.

3. The device according to claim 1, wherein said vent comprises a balloon type cover which allows air displaced by the rising waste within said tubular body member during a waste backup, to move from inside said tubular body member into said balloon type cover without causing any unpleasant odors in the building.

4. A device for the early detection and advanced warning that waste is backing up in a waste pipe line comprising:

a housing having an open lower portion dimensionally sized and configured to be removably yet sealably fitted and fixed into the waste pipe line, and a closed upper portion having a vent;

switching means fixedly secured on said upper closed portion and extending from said upper closed portion into the interior of said housing so that it is surrounded by said housing;

alarm issuing means installed in a remote location distanced away from the installation location of said housing but positioned for easy access and viewing; and communications means connecting said switching means to said alarm issuing means so that when the switching means responds to the rise of liquid waste inside said housing as a result of waste backup in the waste pipe line, it closes a circuit and sends a signal along said communication means to said alarm issuing means, to generate an alarm and provide a window of opportunity to clear up the waste back up.

5. The device according to claim 4, wherein said vent comprises a fitting and a relatively long tube having a first end and a second end, said fitting fixedly attached to said vent, said first end of said relatively long tube being removably fixed onto said fitting and said second end located outside of the building to allow air displaced by the rising waste within said tubular body member during a waste backup, to escape into the outside without causing any unpleasant odors in the building.

6. The device according to claim 4, wherein said vent comprises a balloon type cover which allows air displaced by the rising waste within said tubular body member during a waste backup, to move from inside said tubular body member into said balloon type cover without causing any unpleasant odors in the building.

* * * * *